US006409078B2

(12) United States Patent
Varadarajan

(10) Patent No.: US 6,409,078 B2
(45) Date of Patent: Jun. 25, 2002

(54) COMPOSITE CAN AND METHOD OF MAKING SAME

(75) Inventor: Krishnaraju Varadarajan, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/853,258

(22) Filed: May 11, 2001

Related U.S. Application Data

(62) Division of application No. 09/271,134, filed on Mar. 17, 1999, now Pat. No. 6,230,968.

(51) Int. Cl.[7] ..... B65D 3/26

(52) U.S. Cl. ..... 229/202; 206/813; 206/830; 229/201; 229/245

(58) Field of Search ..... 229/201, 4.5, 202, 229/245; 206/813, 830; 426/128

(56) References Cited

U.S. PATENT DOCUMENTS

| | | | | | |
|---|---|---|---|---|---|
| 2,432,053 | A | | 12/1947 | Waters | |
| 2,543,229 | A | | 2/1951 | Chapman | |
| 2,544,146 | A | | 3/1951 | Erikson | |
| 2,674,974 | A | | 4/1954 | Gwinn et al. | |
| 2,720,665 | A | | 10/1955 | Kile | |
| 2,765,766 | A | | 10/1956 | Davis et al. | |
| 2,875,724 | A | | 3/1959 | Joa | |
| 2,891,714 | A | * | 6/1959 | Vallas | 229/202 |
| 3,015,596 | A | | 1/1962 | Couch et al. | |
| 3,144,193 | A | * | 8/1964 | Geist et al. | 229/202 |
| 3,162,347 | A | | 12/1964 | Taylor | |
| 3,174,676 | A | * | 3/1965 | Stump et al. | 229/202 |
| 3,221,975 | A | * | 12/1965 | Zoerller et al. | 229/202 |
| 3,270,778 | A | | 9/1966 | Foll et al. | |
| 3,331,549 | A | * | 7/1967 | Beasley | 229/202 |
| 3,338,270 | A | | 8/1967 | Denenberg | |
| 3,355,348 | A | | 11/1967 | Lamar | |
| 3,366,493 | A | * | 1/1968 | Stump | 229/202 X |
| 3,545,494 | A | | 12/1970 | Cunningham | |
| 3,587,526 | A | | 6/1971 | Geschwender | |
| 3,663,344 | A | | 5/1972 | Brock et al. | |
| 3,940,496 | A | * | 2/1976 | Turpin et al. | 229/202 X |
| 3,972,468 | A | * | 8/1976 | Reid | 229/202 |
| 3,981,433 | A | | 9/1976 | Thornhill et al. | |
| 3,982,686 | A | * | 9/1976 | Parlour et al. | 229/202 |
| 3,988,521 | A | | 10/1976 | Fumel et al. | |
| 4,073,950 | A | * | 2/1978 | Hansen et al. | 229/202 |
| 4,093,073 | A | * | 6/1978 | Leezer | 229/202 |
| 4,295,840 | A | | 10/1981 | Sansbury | |
| 4,425,106 | A | | 1/1984 | Boegli et al. | |
| 4,757,940 | A | | 7/1988 | Quick et al. | |
| 4,777,058 | A | | 10/1988 | Tobelmann et al. | |
| 5,076,440 | A | | 12/1991 | Drummond | |
| 5,487,506 | A | * | 1/1996 | Drummond et al. | 229/202 |
| 5,494,215 | A | * | 2/1996 | Drummond et al. | 229/202 |
| 5,597,618 | A | | 1/1997 | Bayer, Jr. et al. | |

* cited by examiner

*Primary Examiner*—Lee Young
*Assistant Examiner*—Tri M. Mai
(74) *Attorney, Agent, or Firm*—Alston & Bird LLP

(57) ABSTRACT

A composite can having improved "green" strength is made by pattern printing adhesive onto the exterior label or cover such that the adhesive covers less than 100 percent of the surface of the label. The total amount of adhesive applied between the label and the paperboard body wall is thereby reduced, so that less moisture is added on to the paperboard relative to conventional can-making processes in which adhesive is flooded onto the entire surface of the label. A preferred embodiment of the invention comprises an easy-open can, such as a dough can, having the adhesive applied with relatively denser coverage on the portion of the label that overlies the spiral butt joint that is formed between edges of the spirally wound paperboard body ply, and with relatively less dense coverage on other portions of the label. The denser coverage in the butt joint region helps reinforce the butt joint, and the less dense coverage of other portions of the label can permit those portions to be removed from the can substantially intact. A preferred adhesive is polyvinyl acetate adhesive.

2 Claims, 2 Drawing Sheets

COMPOSITE CAN AND METHOD OF MAKING SAME

CROSS-REFERENCE TO RELATED APPLICATIONS

This application is a divisional of U.S. application Ser. No. 09/271,134, filed Mar. 17, 1999, U.S. Pat. No. 6,230,968 which is hereby incorporated herein in its entirely by reference.

FIELD OF THE INVENTION

The present invention relates to composite cans and, more particularly, to composite cans having an outer covering or label which is removable and/or provides burst resistance to the can.

BACKGROUND OF THE INVENTION

Composite containers are widely used commercially for packaging various products such as snack foods, refrigerated dough products, and the like. Typically, the containers are formed of a helically or convolutely wrapped paperboard or boardstock layer, an inner liner layer providing a moisture barrier function, and an exterior layer that usually forms a label for printed indicia and/or graphics. The various layers of the container are wrapped in strip form onto a mandrel and are secured together by an adhesive applied between the confronting faces of the adjacent layers.

Water-based or "wet" adhesives have become popular because of concerns that the use and disposal of solvent-based adhesives may cause harm to the environment. Conventionally, a wet adhesive is applied to substantially the entire surface of a strip. The water in the adhesive has a tendency to permeate the paperboard body wall and, as a result, the stiffness and dimensional stability of the tubular body wall are compromised.

Consequently, it has been necessary in many cases to hold completed cans in storage for a period of time prior to being filled with product and having end closures seamed on the cans, so that the cans have time to dry to increase their strength sufficiently to be able to tolerate the stresses imposed on them during the filling and seaming operations. Without this holding period, the cans are more prone to being damaged during these subsequent manufacturing steps.

As the line speeds of filling plants continue to increase through efforts to improve efficiency and productivity, the line speeds of container-making plants must also increase to meet the increased demand for containers. Accordingly, because of the reduced time available for the "green" (i.e., freshly made and still wet) tubes to set up and gain strength, it has become increasingly more difficult for parent tubes to go through secondary operations such as cutting the tubes to can lengths, flanging the cans, seaming end closures on the cans, etc., without being damaged.

In the case of composite containers for refrigerated dough products, the above-noted problems are exacerbated by the use of low-tack adhesive for affixing the exterior label layer to the paperboard body wall of the can. The low-tack adhesive is typically used in order to permit the label to be removed substantially in one piece so that baking instructions or the like that are printed on the label are not destroyed during opening of the can. In such dough cans, typically the paperboard body wall is spirally wound such that its edges form a helical butt joint that is easily opened to gain access to the dough product. The butt joint is held closed by the exterior label adhered to the paperboard body wall. Thus, the strength and integrity of the can is dependent largely on the strength of the label and the adherence of the label to the body wall. When a low-tack adhesive is used for affixing the label, the green strength of the can is still further reduced, relative to a can made with high-tack adhesive. Additionally, the burst strength of the can is compromised.

SUMMARY OF THE INVENTION

The present invention enables increased green strength and dimensional stability of composite cans so that parent tubes can undergo secondary operations with less susceptibility to being damaged, and so that the holding period for green cans may be reduced or eliminated. The invention, in preferred embodiments, also enables enhanced performance of composite cans, such as improved burst strength of dough cans while still permitting intact label removal.

To these ends, the invention provides composite cans and methods of making such cans, in which a body wall is constructed from one or more strips of paperboard wrapped about an axis of the can to form a tubular can body, and a exterior cover layer is applied to cover the body wall, and wherein adhesive is applied between the adjoined surfaces of the cover layer and the body wall in a predetermined pattern providing substantially less than 100 percent coverage of the surfaces. The invention thus facilitates a reduction in the total amount of adhesive applied to the body wall relative to conventional techniques employing full-coverage coating of adhesive onto paperboard strips. Consequently, there is less moisture available to permeate the paperboard body wall, so that green strength is improved.

In some preferred embodiments of the invention, the adhesive pattern includes areas of relatively denser coverage and areas of relatively less dense coverage on an adhesive weight per unit area basis. Such nonuniform patterns enable the performance of the composite can to be enhanced in different ways depending on the selected pattern. For example, in one preferred embodiment of the invention, an easy-open composite can of the type used for refrigerated dough comprises a spirally wound liner strip and a body wall formed of a single paperboard strip spirally wound onto the liner in edge-abutting relation so as to form a butt joint that spirally extends lengthwise along the can body. The can includes a cover layer comprising a web-like strip spirally wound onto the body wall with edges of the web-like strip offset from the butt joint. In order to reinforce the butt joint and improve burst strength of the can while still permitting the cover to be removed substantially intact, the adhesive is applied in a relatively higher-density pattern between the body wall and the cover layer in areas of the cover layer adjacent the butt joint, and the adhesive is applied in a relatively lower-density pattern in areas of the cover layer away from the butt joint.

Preferably but not necessarily, adhesive is applied with a relatively high-density pattern in a continuous stripe along the cover layer so that the continuous stripe is adjacent the butt joint of the body wall. In another preferred embodiment, two continuous stripes of adhesive are applied spaced apart slightly so that the two stripes are adjacent to and spaced from the butt joint on opposite sides thereof.

Other aspects of can performance can also be enhanced. For instance, in accordance with one preferred embodiment of the invention, dog-earing (i.e., lifting of an edge of the liner and/or the label) on cut ends of tubes can be reduced by applying a continuous stripe of adhesive along an edge of the liner strip and/or the label strip.

In conventional composite dough can-making processes, dextrin adhesives are commonly used for affixing the label to the can because they have relatively low tack, thus permitting intact label removal, while also providing adequate burst strength under most environmental conditions. It has been found, however, that in very high-humidity environments (e.g., relative humidity greater than 90 percent), the dextrin adhesive can begin to be dissolved by the moisture such that that the label can slip and the container can burst. Furthermore, at somewhat lower relative humidities up to about 90 percent, the peel strength of the label is a strong function of the relative humidity, and at the upper end of this range the peel strength can be so high that it is difficult or impossible to remove the label intact.

To address these problems, in preferred embodiments of the invention, the adhesive comprises a water-insoluble adhesive, examples of which include but are not limited to polyvinyl acetate adhesive (PVA), hot melt adhesives, and acrylates. More preferably, the adhesive is a PVA adhesive. PVA has relatively high tack and, accordingly, has not heretofore been used in commercial can-making processes for affixing labels to easy-open cans because of the desire that the label be removable intact. With conventional flood-coating of adhesive onto the plies, a label affixed with PVA adhesive would be difficult or impossible to remove intact. However, in accordance with the present invention, PVA is applied with a low coat weight relative to a conventional adhesive such as dextrin adhesive, and thus intact label removal is facilitated. Preferably, PVA adhesive is applied in a pattern covering substantially less than 100 percent of the paperboard body wall. The bond strength of PVA adhesive is not substantially influenced by the presence of moisture, and therefore the bond strength of the label is more stable over a range of environment conditions including high-humidity environments.

Various types of adhesive patterns can be used, and the adhesive can be applied in various ways. In one preferred embodiment of the invention, a textured adhesive applicator roll is used for applying adhesive to the label strip. The roll may be etched or machined with the desired pattern, for example, an intersecting grid pattern, a stripe pattern, etc.

The invention thus enables moisture add-on to be reduced and can performance to be enhanced through application of adhesive to plies in a partial-coverage pattern and, in some embodiments, through selective application of adhesive with different adhesive densities to different areas of a ply in accordance with the desired bond strength in those areas. With respect to easy-open composite cans, the invention enables high-tack water-insoluble adhesives to be used for application of the label such that good burst-resistance is achieved and intact label removal can be accomplished at the same time.

BRIEF DESCRIPTION OF THE DRAWINGS

The foregoing and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
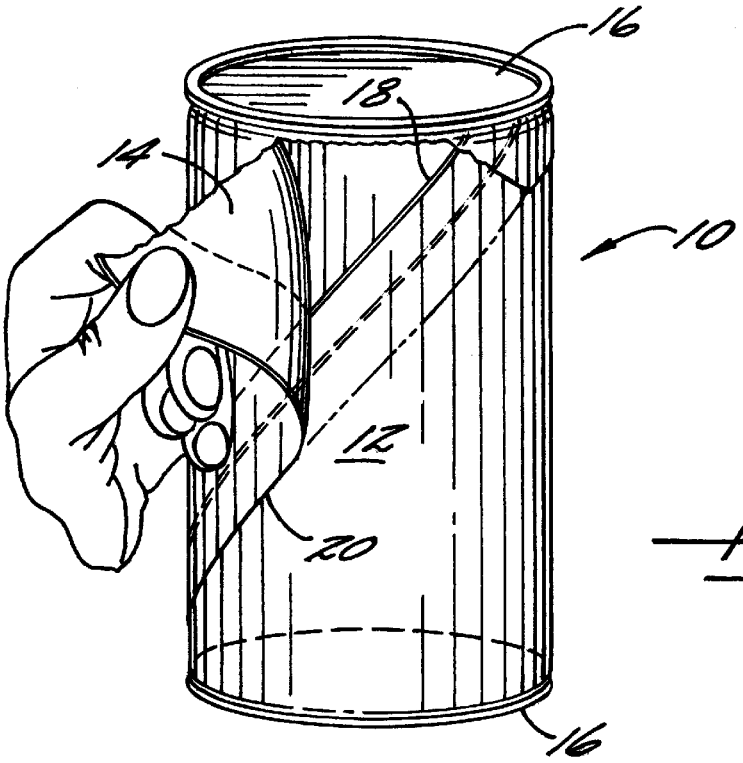
FIG. 1 is a perspective view of a composite can in accordance with a preferred embodiment of the invention, showing an exterior label being removed along a spiral butt joint of the body wall of the can.

With reference to FIG. 1, an easy-open composite can 10 in accordance with a preferred embodiment of the invention is depicted. The can 10 is of the type commonly used for packaging refrigerated dough or the like, and includes a body wall 12 formed of a paperboard strip spirally wrapped into a tubular form, an exterior label 14 spirally wrapped about and adhered to the paperboard body wall, and end closures 16 applied to the opposite ends of the tubular container. The body wall 12 includes a butt joint 18 defined between opposite edges of the paperboard strip. The butt joint 18 forms an opening line along which the can 10 may be opened for access to the product contained therein.

The label strip 14 is wound at the same spiral wind angle as the paperboard strip. The label strip 14 may comprise a strip of paper, a strip of polymer film, a strip of foil laminated to paper, or any other suitable material capable of being adhered to the paperboard body wall 12. The edge 20 of the label strip 14 is of set from the butt joint 18 such that there is a continuous uninterrupted portion of the label that overlies the butt joint and is adhered to the paperboard strip 12 on each side of the butt joint. The butt joint 18 is thus held closed by the label 14 adhered to the outer surface of the body wall 12. As shown in FIG. 1, opening of the can 10 is initiated by peeling the label 14 from the body wall 12 to expose the butt joint. Frequently, pressure exerted by the contents of the can will cause the butt joint to separate and split the label 14 along the butt joint before the label can be completely removed from the butt joint area.

In many cases it is desirable that the label 14 or a certain portion thereof be removable from the body wall 12 substantially intact. For example, the label 14 includes a region 22 that may have baking instructions or other indica printed on it, and it is desirable that the consumer be able to remove the portion 2 of the label intact so that the instructions or indicia can be read after the can is opened. Accordingly, a low peel strength is desirable in order to permit intact label removal. On the other hand, a high peel strength is desirable in order to assure that the label remains adhered to the body wall and keeps the butt joint closed until the consumer opens the can.

Figure 2:
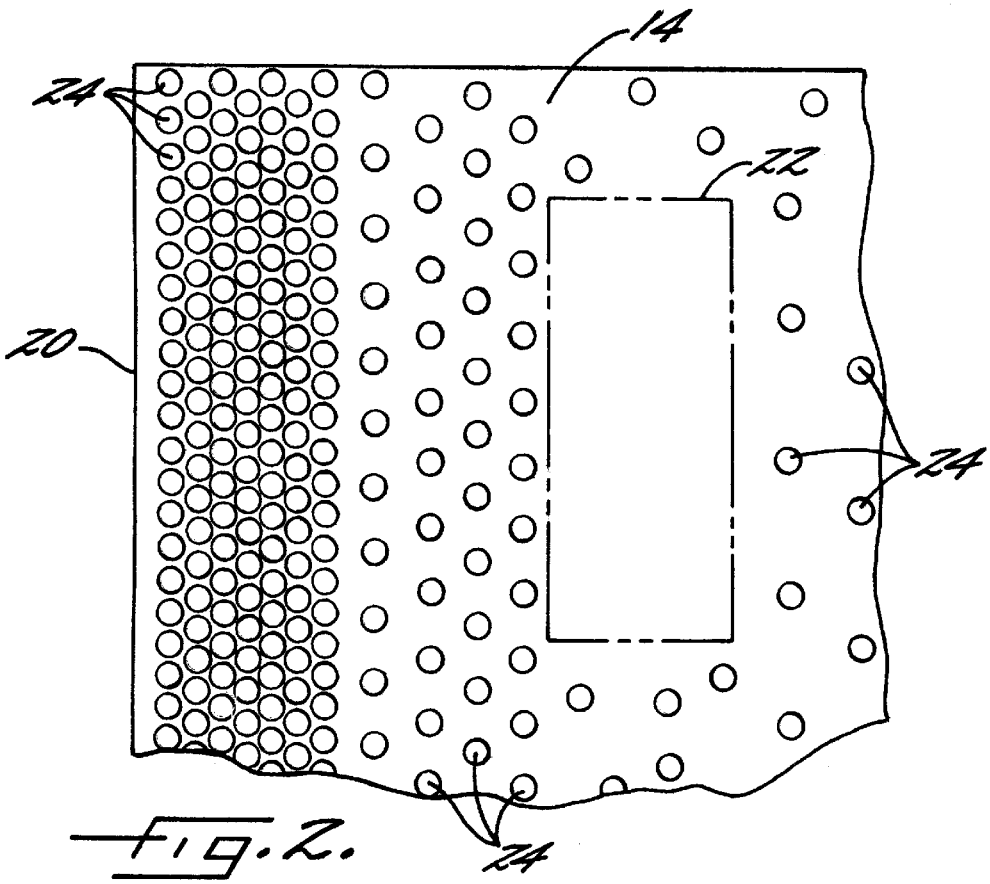
FIG. 2 is a plan view of a portion of the label shown in FIG. 1, showing the adhesive pattern applied to the label.

In accordance with preferred embodiments of the present invention, these two countervailing desires can be reconciled by applying adhesive between the label 14 and the body wall 12 in a pattern, enabling a high bond strength in the butt joint area and a lower bond strength away from the butt joint area. With reference to FIG. 2, the label 14 is printed with adhesive 24 in a pattern that is relatively dense on the portion of the label that overlies the butt joint, and is relatively less dense on the remainder of the label. As shown, the portion 22 of the label may have no adhesive applied to it, if desired, so that the portion can be removed intact. Thus, relatively greater bond strength can be achieved over the butt joint for imparting burst-resistance to the can, while relatively weaker bond strength is provided over the rest of the label so that the label, or at least a portion thereof, can be removed intact.

Various patterns can be used, depending on the strength properties that are desired for the can. In some applications, hoop strength of the can is most important, while in other applications, axial compression strength of the can is of prime concern. Suitable adhesive patterns can be used to reinforce the strength of the can in the desired direction.

Figure 3:
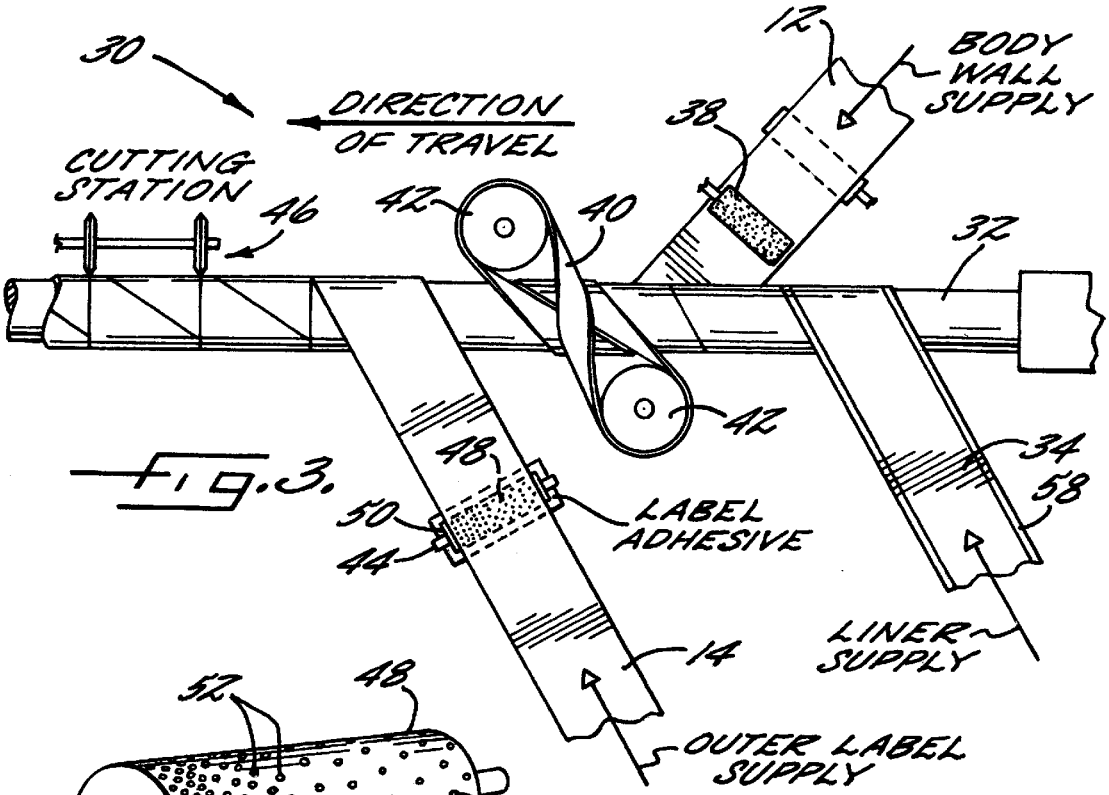
FIG. 3 is a top elevation of an apparatus for making composite cans in accordance with a preferred embodiment of the invention.

With reference to FIG. 3, an apparatus 30 for making composite cans in accordance with the present invention is illustrated. The apparatus 30 includes a mandrel 32 about which various plies are wrapped to form a tube that is cut into can lengths. The mandrel 32 has a cross-sectional shape corresponding to the desired cross-sectional shape of the cans to be made. Although the apparatus 30 illustrated is a spiral tube-forming apparatus for making round cans (i.e., cans of circular cross section), it should be understood that the present invention is applicable to both round and non-round cans. Non-round cans are typically made by a linear draw or convolute wrapping process whereby the various plies are wrapped lengthwise about a non-round mandrel as they are drawn along the mandrel.

A line strip 34 is drawn from a liner supply and spirally wound onto the mandrel 32 into tubular shape. A paperboard body strip 12 is drawn from a body strip supply and is passed through an adhesive applicator 38. The adhesive applicator 38 applies adhesive to the inner surface of the body strip that contacts the liner 34 on the mandrel. The body strip 12 is thus adhered to the liner 34 to form a tubular structure. The outer surface of this tubular structure is engaged by a winding belt 40 that is wrapped about a pair of winding cylinders 42 such that the belt 40 spirally advances the tubular structure along the mandrel 32. A label strip 14 is drawn from a label strip supply and is passed through a pattern adhesive applicator 44, which applies adhesive in a pattern to the inner surface of the label strip that contacts the outer surface of the paperboard body wall on the mandrel. The label strip 14 is then spirally wrapped onto and adhesively joined to the body wall on the mandrel to form a finished tube. A cutting station 46 cuts the finished tube into desired lengths.

Figure 4:
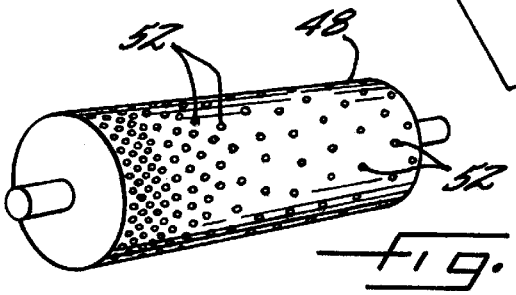
FIG. 4 is a perspective view of a textured adhesive applicator roll for applying patterned adhesive in accordance with the invention.

The pattern adhesive applicator 44 advantageously comprises a textured glue roll 48, shown in more detail in FIG. 4, which is rotated about its axis and partially submerged in a glue pot 50 such that the surface of the roll 48 picks up adhesive from the glue pot and is then rotated around to contact and transfer the adhesive onto the label strip 14. The surface of the roll 48 is machined, etched, or otherwise treated, to form recessed or depressed regions 52 in a pattern corresponding to the desired pattern of adhesive to be applied to the label strip. The roll 48 is rotated such that its peripheral speed matches the linear speed of the label strip 14. The applicator 44 includes a doctor blade (not shown) or the like for scraping excess adhesive from the surface of the roll 48 before the roll contacts the label strip so that adhesive remains only in the recessed regions 52. Accordingly, adhesive is applied to the label strip in the desired pattern. Various other types of devices can be used for applying adhesive to the label strip in a desired pattern.

Figure 5:
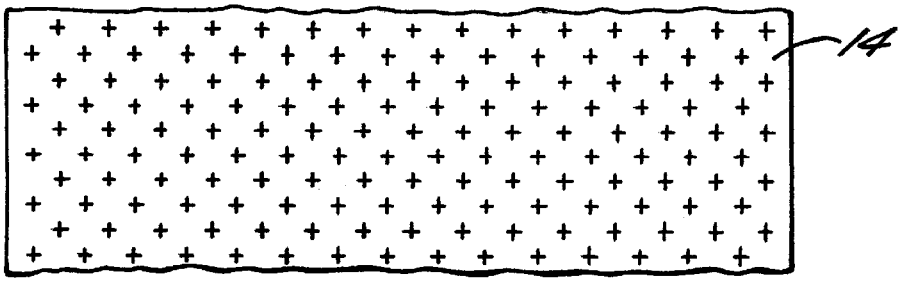
FIG. 5 is a plan view of a portion of a label having a uniform low-density adhesive pattern in accordance with another preferred embodiment of the invention.

Many different types of adhesive patterns can be used for achieving different mechanical properties of the completed cans and for reducing the amount of adhesive used. For example, a partial-coverage pattern such as shown in FIG. 5 can be applied to the label strip 14 in order to reduce the amount of adhesive used and the amount of moisture added onto the paperboard body wall of the cans. By reducing moisture add-on, the "green" strength of the parent tubes and cans can be significantly increased, thus improving the dimensional stability and enabling the green cans or parent tubes to be subjected to manufacturing operations such as cutting, flanging, etc., without being damaged. Cost of the can may also be reduced by reducing the amount of adhesive used.

Figure 6:
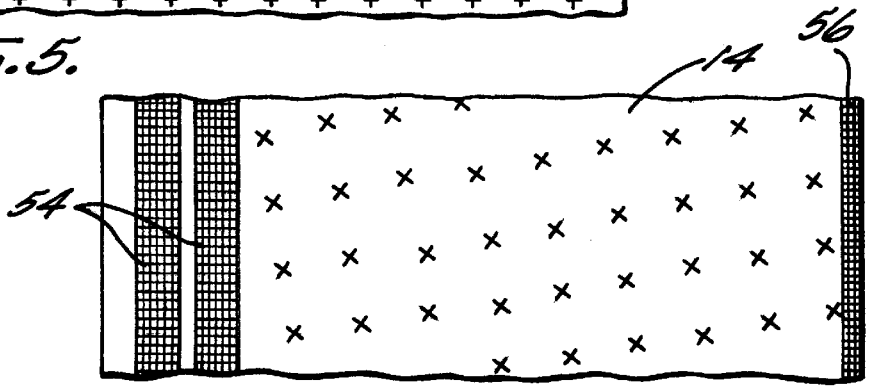
FIG. 6 is a plan view of a portion of a label having a full-coverage adhesive stripe extending lengthwise along the label and having a low-density coverage over the remainder of the label in accordance with still another preferred embodiment of the invention.

As another example, adhesive can be applied to the label strip 14 in a pattern that includes a pair of continuous stripes 54 of adhesive covering a portion of the label strip with the remainder of the strip having a partial-coverage pattern, as shown in FIG. 6. The adhesive stripes 54 are spaced apart and located such that the stripes are adjacent to and spaced on opposite sides of the body wall butt joint when the label strip is wrapped onto the body wall. As another example, to reduce or eliminate the edge of the label from being lifted away from the body wall on the cut ends of a can, it may be desirable to apply a narrow stripe of adhesive along one or both edges of the label strip. A similar adhesive stripe can be applied along the edges of the outer surface of the liner strip 34 (FIG. 3) by a pattern adhesive applicator such as the applicator 44 to reduce or eliminate edge lift of the liner on the cut ends of the can.

Various types of adhesives can be used within the scope of the present invention. In many cases, wet adhesives provide satisfactory performance. The present invention provides benefits where wet adhesives are used, by enabling the amount of adhesive to be reduced, thus reducing moisture add-on as previously noted. In some cases, however, wet adhesives may not be optimum. For example, as noted above, wet adhesives can be sensitive to relative humidity, causing label slippage and/or widely varying label peel strength as a function of the relative humidity. These problems are particularly vexing for easy-open cans, which derive their strength and burst resistance largely from the adherence of the label to the body wall. Ideally, in such cans, label peel strength should not be affected by relative humidity, and should be great enough to provide adequate burst resistance. On the other hand, it is often desirable to be able to remove the label, or at least a portion thereof, substantially intact. To address these considerations, a preferred embodiment of the invention employs water-insoluble adhesive for adhering the label to the body wall. Suitable adhesives include polyvinyl acetate (PVA) adhesives, hot melt adhesives, and acrylate-based adhesives, with PVA being particularly preferred for easy-open dough cans. PVA adhesives are largely unaffected by changes in relative humidity, and thus label peel strength can be relatively constant over a wide range of environmental conditions. However, PVA has a very high tack, and for this reason (as well as its relatively high cost) has not been commercially used heretofore in the production of dough cans, because a label attached with PVA applied by a conventional full-coverage applicator would be difficult or impossible to remove in one piece. The present invention enables PVA to be used in the manufacture of dough cans or the like. More particularly, PVA can be applied with a relatively dense (or full-coverage) pattern on the portion of the label strip that overlies the butt joint, thus providing good burst resistance for the can, and the remainder of the label can have a relatively low-density adhesive coverage so that the label or portion thereof can be removed intact.

Many modifications and other embodiments of the invention will come to mind to one skilled in the art to which this invention pertains having the benefit of the teachings presented in the foregoing descriptions and the associated drawings. For example, pattern printing of adhesive onto labels has been illustrated and described, but in some cases it may be desirable to pattern print adhesive onto a body ply instead of or in addition to pattern printing adhesive onto the label. As another example, adhesive can be applied in a pattern between a liner ply and the adjacent body wall such that the adhesive covers substantially less than 100 percent of the surface of the liner ply. The invention encompasses all such uses of pattern printing for adhering the various plies of a multiple-ply composite container to one another, Therefore, it is to be understood that the invention is not to be limited to the specific embodiments disclosed and that modifications and other embodiments are intended to be included within the scope of the appended claims. Although specific terms are employed herein they are used in a generic and descriptive sense only and not for purposes of limitation.

What is claimed is:

1. A composite can, comprising:

a body wall constructed from one or more strips of paperboard wrapped about an axis of the can to form a tubular can body, the body wall having an outer surface defined by an outermost paperboard strip, the body wall having an inner surface defined by an innermost paperboard strip;

a cover layer covering the body wall with an inner surface of the cover layer confronting the outer surface of the body wall, the cover layer being adhered to the body wall by an adhesive which is applied in a predetermined pattern between the inner surface of the cover layer and the outer surface of the body wall, the pattern providing substantially less than 100 percent adhesive coverage of said surfaces; and a liner covering the inner surface of the body wall and adhered thereto by an adhesive which is applied in a predetermined pattern such that the adhesive covers substantially less than 100 percent of the liner, wherein the cover layer and the liner each comprises a web-like strip spirally wound about the axis of the can body, and wherein the adhesive is applied in a continuous narrow stripe along an edge of at least one of the web-like strips for reducing the tendency of said edge to be lifted away from the body wall at a cut end of the can body said edge forms a helical joint along said body wall.

2. An easy-open composite can comprising:

a body wall constructed from at least one strip of paperboard spirally wound about an axis of the can in edge-abutting relation to form a tubular can body having a butt joint helically extending therealong, the body wall having an outer surface defined by an outermost paperboard strip; and a label strip spirally wound onto the body wall with edges of the label strip offset from the butt joint and with an inner surface of the label strip confronting the outer surface of the body wall, the label strip being adhered to the body wall by one of a polyvinyl acetate adhesive, a hot melt adhesive, and an acrylate-based adhesive applied with a textured applicator roll so as to cover substantially less than 100 percent of the inner surface of the label strip, wherein the adhesive is applied in a predetermined pattern between the inner surface of the label strip and the outer surface of the body wall, the pattern including a plurality of separate adhesive spots spaced relatively close together so as to form an area of relatively high-density adhesive coverage proximate the butt joint and a plurality of separate adhesive spots spaced relatively farther apart so as to form areas of relatively low-density adhesive coverage spaced from the butt joint.

* * * * *